United States Patent [19]

Brooke

[11] 3,994,723

[45] Nov. 30, 1976

[54] ELECTROPHOTOGRAHIC PROCESS INVOLVING STEPS OF SUBSEQUENT DISCHARGE OF AREAS RECEIVING INSUFFICIENT EXPOSURE

[75] Inventor: Edric Raymond Brooke, Welwyn Garden City, England

[73] Assignee: Xerox Corporation, Stamford, Conn.

[22] Filed: Mar. 17, 1975

[21] Appl. No.: 558,758

Related U.S. Application Data

[62] Division of Ser. No. 450,269, March 11, 1974, Pat. No. 3,912,387.

[52] U.S. Cl. ..... 96/1 R; 356/162

[51] Int. Cl.[2] ..... G03G 13/00

[58] Field of Search ..... 96/1 R, 1.3; 356/162; 355/17

[56] References Cited

UNITED STATES PATENTS 3,788,739 1/1974 Coriale ..... 96/1

*Primary Examiner*—John D. Welsh

[57] ABSTRACT

A process for producing an electrostatographic image wherein a uniformly charged photoconductive plate is exposed to a pattern of light and shadow to produce an electrostatic latent image, the continuous zones of the photoconductive plate which do not receive sufficient light during the exposure to discharge the plate are subsequently discharged and thereafter the charged areas of the plate are developed to provide a developed electrostatograpic image.

4 Claims, 8 Drawing Figures

Figure 3:
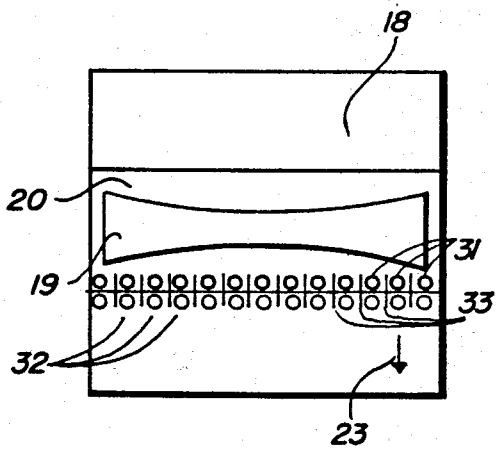

ELECTROPHOTOGRAHIC PROCESS INVOLVING STEPS OF SUBSEQUENT DISCHARGE OF AREAS RECEIVING INSUFFICIENT EXPOSURE

This is a division of application Ser. No. 450,269, filed Mar. 11, 1974, now U.S. Pat. No. 3,912,387.

In one well known form of automatic xerographic reproduction machine, a moving photoconductive plate, generally in the form of an endless surface, such as a drum or the like, is first uniformly charged and the surface then exposed to a light pattern of the image sought to be reproduced thereby to discharge the charge in the areas where light strikes the plate. The undischarged areas of the layer thus form an electrostatic charge pattern in conformity with the configuration of the original image pattern.

The electrostatic latent image may then be developed into visible form by applying a developer material, e.g. a powder, generally referred to as toner, to the plate using any one of a number of development means generally known and used in the art. Subsequent to the development operation, the now visible image is transferred from the plate to a sheet of final support material such as paper or the like and suitably affixed to it thereby forming a permanent print.

Instead of being developed by means of a powder, the latent image may be developed using a liquid development system such as is described in U.S. Pat. No. 3,084,043.

It often occurs that the electrostatic latent image area formed is smaller than the area which has been charged so that after exposure to the light image edge zones of the plate bounding the latent image remain unexposed to light and therefore retain the charge. In machines having solid area development capability (which is a feature of the above-mentioned liquid development system) this is a particular problem since when the photoconductive layer is then developed, toner is deposited in these edge zones and consequently produces solid areas of toner in these zones. If these regions do not come into contact with the copy material then the toner deposited in these zones and left behind on the plate surface after the transfer operation must be removed or cleaned from the plate surface in some manner before a new imaging cycle can be initiated. Removal of this toner can prove to be a problem in the automatic xerographic process not only because it is dirt producing, but also because where large volumes of residual toner are involved, these may act rapidly to overload the machine's cleaning system and result in a waste of material to the user. On the other hand if these edge zones come into contact with the copy material then the latter will have solid coloured marginal zone along one or more edges, which is unsightly.

Various what may conveniently be termed edge fade-out systems have been proposed for the purpose of avoiding or reducing wastage of developer material and of eliminating or reducing solid marginal edge zones on copies. Thus in U.S. Pat. No. 3,687,538, for example, illuminating means disposed in a rectangular frame surrounding the image area is energised to discharge the photoreceptor in the areas surrounding the image area. In the system described in British patent specification No. 1,230,526, which is incorporated in a machine employing flash exposure, a lamp extending transversely across the path of a photoreceptor belt is activated by a suitable logic system a short predetermined time after de-energisation of the flash exposure lamps. In U.S. Pat. No. 3,685,894, a photoelectrostatic copying machine is described which has reduction mode copying facility and, in reduction mode, portions of the copy sheet, which in this case is itself adapted to receive the electrostatic latent image and so forms the xerographic plate, are not fully exposed. In order to avoid the production of dark or "dirty" edge zones which would otherwise occur in reduction mode of operation a pair of lamps are provided over the edge zones which are switched in only when reduced mode is selected so as automatically to be energised in this mode and scan the predetermined edge zones.

While all the machines described above have the desirable effect of reducing wastage of toner and/or of avoiding or reducing solid marginal areas on copies, a need still exists to be able to predict the production of an unwanted solid development area other than under specific predetermined conditions such as operation in reduction mode in the case of U.S. Pat. No. 3,685,894.

From one aspect, the present invention provides an electrostatographic process including the steps of a. applying a uniform electrostatic charge to a photoconductive plate,
b. exposing the charged plate to a pattern of light and shadow to produce an electrostatic latent image on the plate,
c. developing charged areas of the plate,
d. detecting continuous zones of the plate which do not receive sufficient light during exposure step (b) to discharge the plate, and
e. discharging the plate in said zones.

From another aspect, the invention provides, in or for an electrostatographic apparatus including a photoconductive plate, means for applying a uniform electrostatic charge to the plate, exposure means for exposing the charged plate to a pattern of light and shadow to produce an electrostatic latent image on the plate, and developer means for developing charged areas of the plate; means for detecting continuous zones of the plate which do not receive sufficient light from said exposure means during exposure of the plate to discharge the plate and discharge means controlled by said detecting means for discharging the plate in said zones.

It is to be understood that by the references to discharging zones of the photoconductive plate made herein and in the claims, is meant that the charge on the plate will be reduced to a value such that developer material will not be attracted thereto.

Suitably said detecting means comprises one or more light sensitive detectors arranged in the optical path of the exposure means. The discharge means may comprise one or more discharge lamps extending transversely across the plate.

In a preferred form of the invention for use in a machine in which, in operation, successive portions of a document to be reproduced are exposed through a slit onto a moving electrostatographic plate, detecting means sensitive to light is provided in the light path defined by the exposure means and one or more discharge devices, suitably lamps, are operated as a function of the intensity of light received by said detecting means. This may be achieved by determining the intensity of light required to reduce the plate charge to a value such that developer material will not be attracted thereto and providing that the detecting means will cause the discharge device(s) to be activated only when the detecting means receives light of less than such intensity (including no light).

The discharge system of this invention may operate only to discharge predetermined zones of a photoconductive plate. For example a discharge device in the form of a single lamp, or a row of lamps connected to operate in unison, may be arranged transversely across the plate and a plurality of light-sensitive detectors may be provided transversely across the plate, operation of the discharge device only being effected where all detectors receive less than a predetermined intensity of light. Such an arrangement would permit the discharge of solid or continuous charge zones at opposite ends, in the direction of movement of the plate, of the desired image area whilst enabling solid area development to be achieved within the desired image area.

With the above arrangement, undesired solid or continuous charge zones may still be produced at the sides of the desired image area and in order to avoid this, the discharge device could be split into three or more sections, each operated by one, or preferably a transversely extending series of, detectors. The lengths of such sections would be chosen according to known parameters such as paper size, document size or reduction mode.

In a further form of the invention a row of lamps extends transversely across the plate and a detector is associated with each lamp. Whilst in some circumstances the above arrangements will result in the elimination of desired solid or continuous charge areas within the image area, manual means could be provided for switching out the discharge means in these circumstances.

While in some instances, the present invention will perform the same functions as are achieved by the known devices described above, it provides the significant advantage of enabling the elimination of solid development areas which cannot or have not been predetermined in terms of machine function. Thus, for example, in the form described above, in which a lamp means is controlled by a plurality of detectors spaced across the plate, the elimination of continuous charge zones at opposite ends of the image area is effected regardless of their length in the direction of plate movement and without control by any other machine function.

Figure 1:
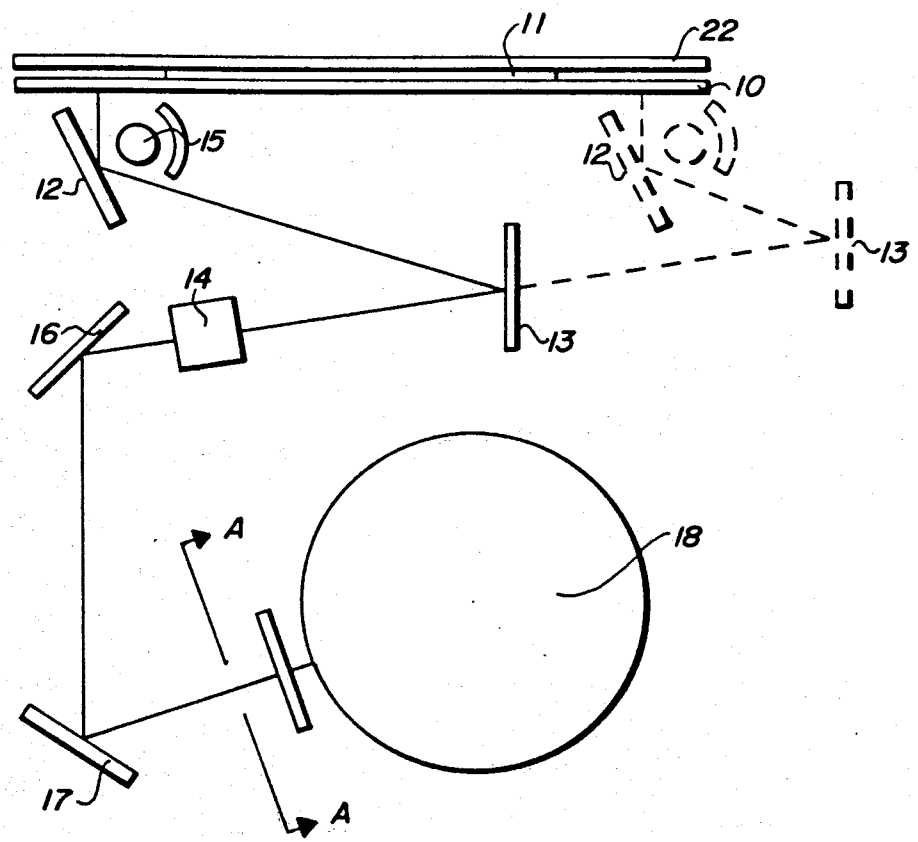
Figure 2:
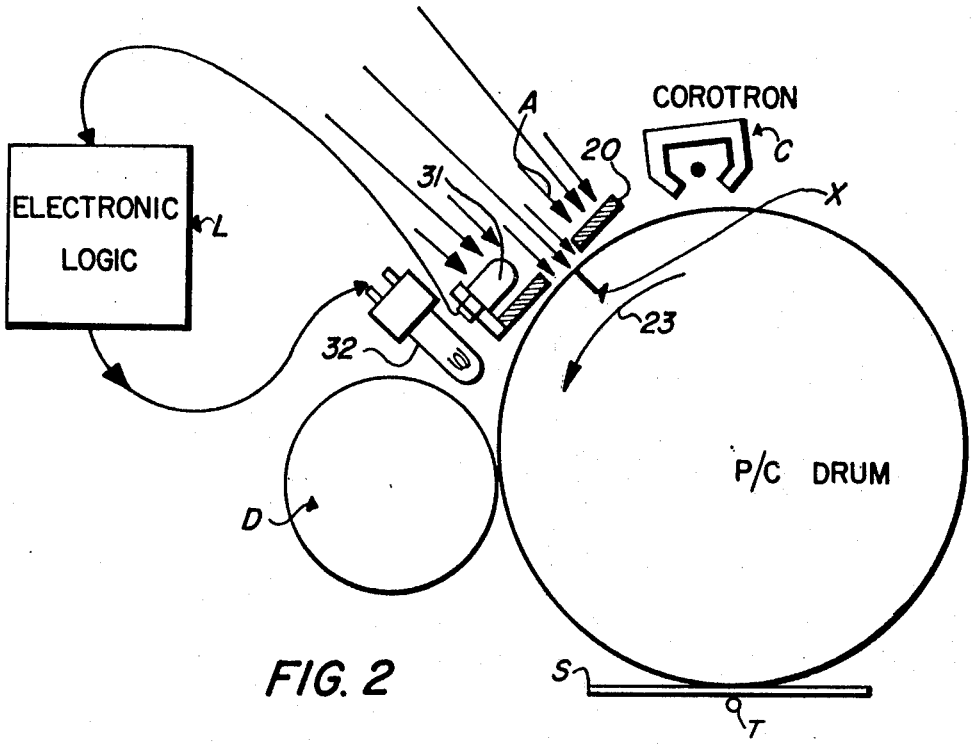
Figure 6:
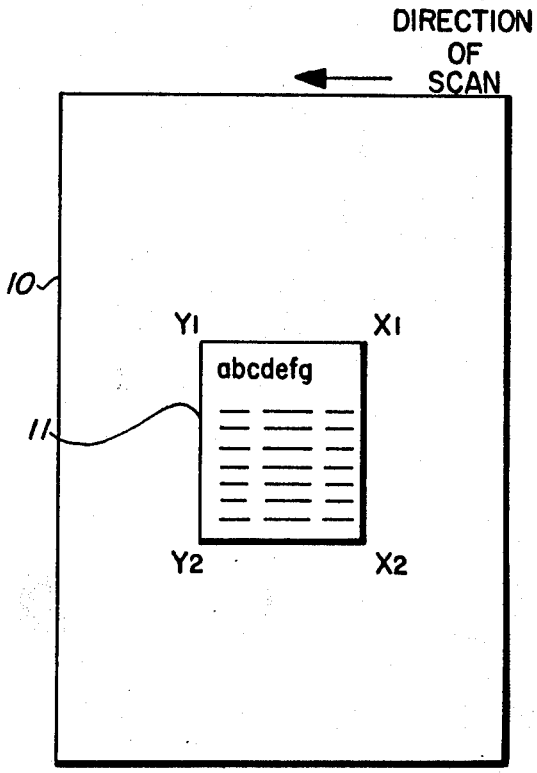
Figure 4:
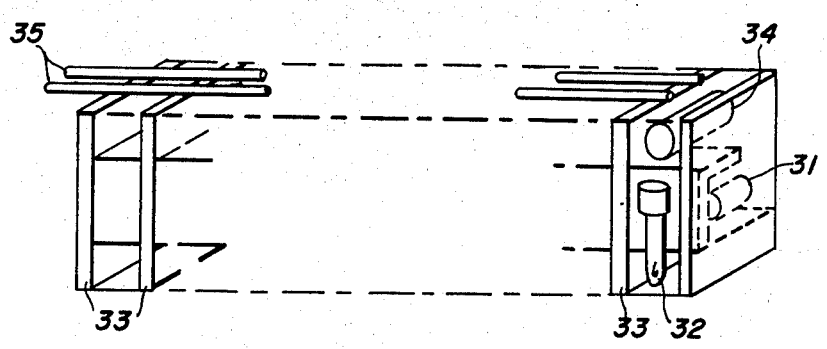
Figure 5:
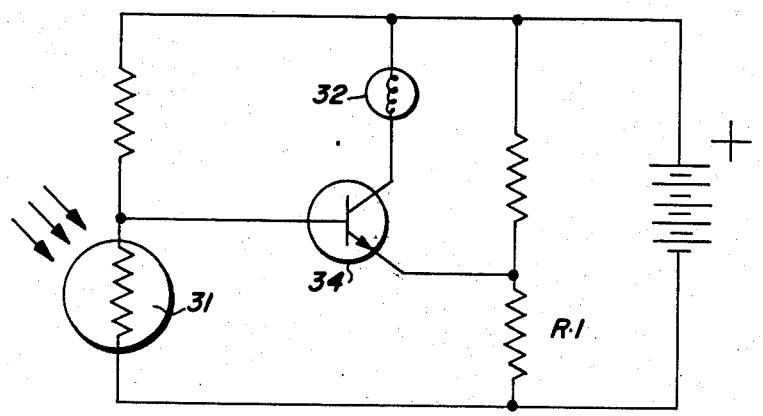
Figure 8:
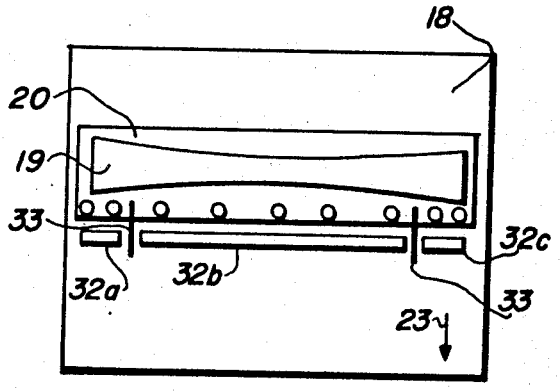
Figure 7:
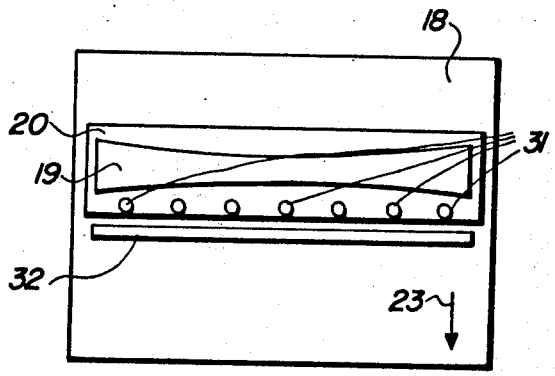

In order that the invention may be more readily understood, reference will now be made to the accompanying drawings in which:

FIG. 1 is a schematic view of one form of document scanning system for an electrostatographic machine, FIG. 2 is a schematic view of one embodiment of development control system according to the invention, FIG. 3 is a view illustrating the embodiment of FIG. 2 taken along the line A—A of FIG. 1, FIG. 4 is a view of a unitary mounting arrangement for the embodiment of FIG. 2, FIG. 5 is an illustration of a suitable electronic control circuit, FIG. 6 is a representation of a document to be copied for the purpose of explaining modes of operation of development control systems of this invention, FIG. 7 is a view like that of FIG. 3 of a second embodiment of the invention, and FIG. 8 is a view like that of FIG. 3 of a third embodiment of the invention.

To facilitate appreciation of this invention, one form of document scanning system for a xerographic machine in which the xerographic plate is exposed to light reflected from successive portions of a document to be copied through a slit will first be described with reference to the schematic representation of FIG. 1.

A platen 10 is provided to support the document 11 to be copied. A scanning mirror system includes two moveable mirrors 12 and 13 shown in their extreme left and right positions in full and dotted outline respectively. The mirror 13 is arranged to move at half the speed of the mirror 11 during scanning to maintain the optical distance constant between the document 11 and a lens 14. A tubular lamp 15 extending across the platen 10 parallel to the mirror 12 moves with the mirror 12 in fixed relation thereto. The lamp 15 is provided as illumination means to illuminate the document 11 through the platen 10 during scanning.

An optical or light path extending from the platen 10 to the lens 14 continues beyond the lens to be reflected in sequence by mirrors 16 and 17 towards a photoreceptor drum 18. An optical slit 19, better seen in FIG. 3, is provided in a cover plate 20. A platen cover 22 is provided over the platen so that it will lie on the document 11.

The configuration or shape of the slit 19 is, as shown, narrower at its mid-point than at its extremities. This shape, as is already known in the art, is to compensate for the non-uniformity of light output from the lamp across its length.

The document 11 is scanned by the sweep of the mirrors from left to right producing a latent image of the information on the document on the photoreceptor 18 which rotates in synchronism with the movement of the mirrors 12 and 13 in the direction of arrow 23. Where the underside of the platen cover has a reflective surface, light striking the platen cover beyond the edges of the document will be reflected along the optical path.

As illustrated in FIG. 2 a xerographic machine incorporating such a scanning system is also provided with charging, development and transfer stations C, D and T arranged in the relative locations indicated. In this embodiment, a liquid development system is employed, being represented schematically by an applicator roll of such a system, but it should be appreciated that in the case of a powder or particulate development system a fusing station should be provided following the transfer station for securing the toner particles to the copy material S in a permanent form.

The general operation of the machine illustrated is as follows. Prior to exposure, the drum surface, which comprises a layer of photoconductive insulating material which may, for example, be vitreous selenium supported on a conductive backing such as aluminium, is sensitised by means of a corona generating device at the charging station C, which is energised from a suitable high potential source (not shown). Such generating device may be an adaption of the type disclosed in U.S. Pat. No. 2,965,756.

Exposure of the drum to the light image discharges the photoconductive layer in the areas struck by light, whereby there remains on the drum a latent electrostatic image in image configuration corresponding to the light image projected from the document. As the drum surface continues its movement the electrostatic latent image passes through the developer station D at which, in this machine configuration, a liquid developer material is applied to the drum to produce a visible image thereon. Following development the visible image passes through the image transfer station T at which the visible image is transferred to a sheet of copy paper, which is fed into contact with the rotating drum in coordinated registration with the arrival of the developed image at the transfer station. Following transfer, a suitable pick-off mechanism (not illustrated) separates the copy sheet from the drum surface whereafter the copy sheet is directed into a suitable copy-holder for removal by an operator.

After transfer, the xerographic drum surface passes through a cleaning station (not illustrated) at which the surface is cleaned suitably by a doctor blade arranged in contact with the drum for doctoring the developer material remaining on the drum surface.

One embodiment of development control system according to this invention will now be described with particular reference to FIGS. 2 and 3. In the system illustrated the exposure slit 19 is narrower than the optical path so that the rays having imaged on the drum at X pass on to a row of photo diodes 31 extending transversely across the drum. Each photo diode is associated with a lamp 32 controlled as a function of the intensity of light impinging on the photodiode by a suitable electronic logic system L in the following manner. When light of less than a predetermined intensity (sufficient to reduce the charge on the plate to a value such that developer material will not be attracted thereto) is impinging on a photodiode the corresponding lamp is energised thus discharging the drum area passing beneath it; when light of greater than the predetermined intensity impinges upon the photodiode the lamp is not energised. The lamp should extinguish or light, as the case may be, only after a predetermined time delay dependent upon the circumferential distance between the photodiode and the lamp and the rotational speed of the drum following detection of a change in intensity by the corresponding photodiode. This is necessary since the lamp is arranged in a trailing position (in the direction of drum rotation) relative to the photodiode. Filament lamps will have their own delay characteristic which may provide the required time delay.

Suitable choice of the extent by which the photodiodes extend into the optical path and of the threshold value of light intensity to which the photodiodes respond, will permit lines on the document of desired width to be reproduced on the copy. The arrangement above-described with its separately operable multiplicity of lamps each acting on only a short transverse section of the drum enables close control of development to be achieved. In order to prevent, or at least reduce to a minimum, overlapping effects from adjacent lamps, baffles or shields 33 are provided between the lamps to restrict the area of effect of each lamp, and for the additional purpose of providing a sharp contrast between those zones of the drum surface which are discharged by the lamps and those which are not.

If desired, instead of being switched off completely when inoperative, the lamps may be maintained lit at a low level of intensity insufficient to discharge the drum area therebeneath in the manner described in British patent specification No. 1,230,526.

FIG. 4 shows a convenient mounting arrangement for the development control system described above in which the detector/lamp sub-units are mounted in an elongate unit extending across the width of the drum and which also includes the necessary control circuitry, a simplified form of which for a single sub-unit is illustrated in FIG. 5. The operation is as follows. When less than the predetermined threshold intensity of light is falling on the photocell 31 it has an effective high resistance and the voltage across resistor R1 is applied to the emitter of transistor 34 and current flows through the lamp 32. When the photocell receives light above the threshold intensity its resistance drops causing the voltage across R1 to drop sufficiently to cause the lamp current to drop and extinguish the lamp.

As shown in FIG. 4, the circuits associated with each lamp are all connected to bus-bars 35 leading to a common supply. In the unit illustrated, each sub-unit is separated by a light shield or baffle 33 and the complete unit may be encapsulated in a transparent resin.

This embodiment has particular application to the elimination of unwanted solid area development of marginal edges zones of a copy sheet which would otherwise occur where the document to be copied is small compared with the glass platen size and either the platen cover is raised or the document has a substantial thickness (e.g. it may be a book) so preventing the platen cover from coming close to the platen. In this event, light from the lamp 15 which passes through the platen in the areas surrounding the document 11 (see FIG. 6) will not be reflected down the optical path and the corresponding areas of the drum surface will not be discharged during exposure. The development control system described above will operate as follows. Until the image of the document edge $X_1X_2$reaches the photodiodes 31, all lamps 32 will be lit and the drum will be discharged. As edge $X_1X_2$reflects light the lamps will be extinguished across the portion of the drum between $X_1$ and $X_2$ and an electrostatic latent image of the document information will be produced on the drum surface. After the $Y_1Y_2$edge passes the exposure slit 19 no further light will reach the photodiodes 31 and all the lamps 32 will again be lit, discharging the remaining area of the drum. The pitch of the photocells 31 and the lamps 32 will determine the sharpness of the $X_1Y_1$and $X_2Y_2$edges. In the above description of operation it is presupposed that the document contains only line information and no substantial solid dark areas.

Further embodiments of the invention are schematically illustrated in FIGS. 7 and 8. In the embodiment of FIG. 7 a single tubular lamp 32 is arranged transversely across the drum surface and a row of photocells 31 extend in a row across the drum. The photocells 31 are so connected to the lamp 32 that the lamp will only be lit when all the photocells receive less than the pre-set threshold intensity of light. With this arrangement, in the circumstances described above with reference to FIG. 6, only those areas or zones of the drum beyond the document edges $X_1X_2$ and $Y_1Y_2$ will be discharged, but solid areas within the image area on the drum will be reproduced. The embodiment of FIG. 8 permits the elimination of the undischarged marginal zones along the image edges corresponding to $X_1Y_1$ and $X_2Y_2$ which will remain with the embodiment of FIG. 7, without eliminating solid area development within the image area, where the width of these marginal zones can be predetermined, e.g. as a function of copy size or reduction mode of operation of the machine. Here the lamp 32 is split into three sections 32*a*, 32*b* and 32*c*, each associated with its own series of photocells 31. Beyond the edges corresponding to $X_1X_2$ and $Y_1Y_2$ of FIG. 6 all three lamps will be lit but between $X_1X_2$ and $Y_1Y_2$ only the outer lamps 32*a* and 32*c* which are of a length corresponding to predetermined marginal zones of the drum, will be lit.

While particular embodiments have been described above, it will be appreciated that various modifications may be made to the specific details referred to herein without departing from the scope of the invention. For example, instead of being arranged as shown, the photocells could be arranged across the drum at position A indicated in FIG. 2 so as to receive advance information of the intensity of light about to fall on the drum.

Further, it is contemplated that embodiments of this invention could be used in conjunction with known development control systems, as comprehended for example by the prior art described above.

What we claim is:

1. An electrostatographic process including the steps of:

a. applying a uniform electrostatic charge to a photoconductive plate, b. exposing the charged plate to a pattern of light and shadow to discharge selected areas of the plate and produce an electrostatic latent image on the plate, c. detecting continuous zones of the plate which do not receive sufficient light during exposure step (b) to discharge the plate, d. discharging the plate in said zones, and e. developing charged areas of the plate.

2. An electrostatographic process including the steps of:

a. applying a uniform electrostatic charge to an electrostatographic plate, b. discharging selected portions of the electrostatographic plate to produce an electrostatic latent image on the plate, c. detecting continuous zones on the plate which are not discharged during step (b), and d. discharging the plate in the detected continuous zones.

3. An electrostatographic process according to claim 2 further including the step of developing the charged areas of the plate after the continuous zones thereon have been discharged.

4. An electrostatographic process according to claim 1 wherein said electrostatographic plate includes a photoconductive layer, the discharge of selected portions of the charged plate being accomplished by the step of exposing the charged photoconductive layer to a pattern of light and shadow to discharge the layer in areas exposed to the light to produce an electrostatic latent image on the plate.

* * * * *